US005368232A

United States Patent [19]

Schroeder

[11] Patent Number: 5,368,232

[45] Date of Patent: Nov. 29, 1994

[54] STRIPING APPARATUS FOR VEHICLE TRAVEL SURFACES

[75] Inventor: James C. Schroeder, Golden Valley, Minn.

[73] Assignee: Graco, Inc., Golden Valley, Minn.

[21] Appl. No.: 912,892

[22] Filed: Jul. 13, 1992

[51] Int. Cl.[5] ..... B05B 13/02

[52] U.S. Cl. ..... 239/165; 239/172; 239/150

[58] Field of Search ..... 239/165–168, 239/150, 172

[56] References Cited

U.S. PATENT DOCUMENTS

| | | | |
|---|---|---|---|
| 1,720,273 | 7/1929 | Henry . | |
| 2,076,370 | 4/1937 | Hollingshead . | |
| 2,192,433 | 3/1940 | Cornelison . | |
| 2,304,726 | 12/1942 | Beaman . | |
| 2,518,952 | 8/1950 | Sohmer . | |
| 2,575,521 | 11/1951 | Ireland | 239/168 |
| 2,975,979 | 3/1961 | Shaffer . | |
| 3,477,352 | 11/1969 | Harding et al. . | |
| 4,256,261 | 3/1981 | Gurney . | |
| 4,267,973 | 5/1981 | Stewart . | |
| 4,442,975 | 4/1984 | Long et al. . | |
| 4,650,124 | 3/1987 | Connaughty et al. | 239/168 X |
| 4,768,715 | 9/1988 | Sali et al. | 239/166 |
| 4,915,276 | 4/1990 | Devito . | |
| 4,962,892 | 10/1990 | Sauer | 239/167 X |

FOREIGN PATENT DOCUMENTS

| | | | |
|---|---|---|---|
| 533929 | 12/1950 | Canada | 239/150 |

*Primary Examiner*—Andres Kashnikow
*Assistant Examiner*—Kevin P. Weldon
*Attorney, Agent, or Firm*—Moore & Hansen

[57] ABSTRACT

A stripe painting apparatus is attachable to square opening hitch receivers mounted on the rear of a pickup truck or other vehicle. The apparatus includes a transverse tubular sleeve in which a boom may be slidably locked to extend outwardly to the left or right. A forwardly extending carriage with a wheeled front end pivots on the boom and carries paint spray heads and applicators for distributing reflective beads onto the wet paint. The carriage pivots between a lower operating position and a locked upright position for highway transport. A pair of crankable jacks with elongate feet mounted on the jack legs are cranked down for ground support during mounting and removal of the apparatus from the vehicle, and for storage of the apparatus. A line guide mounts at any location of a steel vehicle body, enabling one-person operation of the apparatus from the driver's seat using a remote control box.

25 Claims, 9 Drawing Sheets

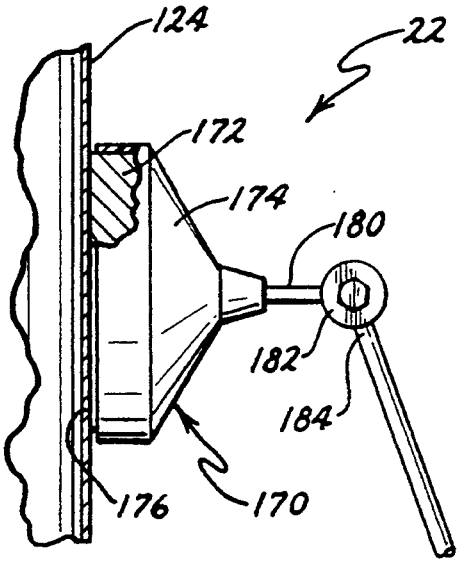
FIG. 7
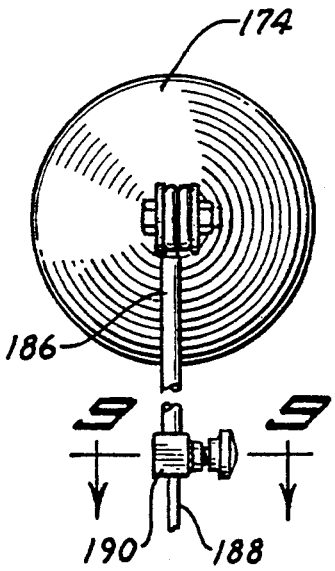
FIG. 8
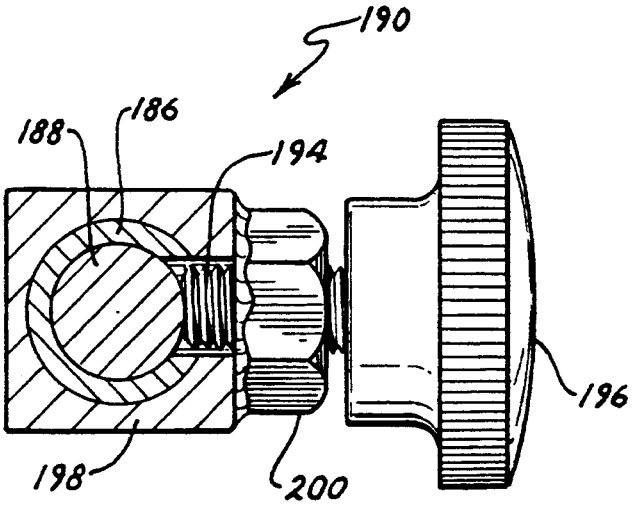
FIG. 9
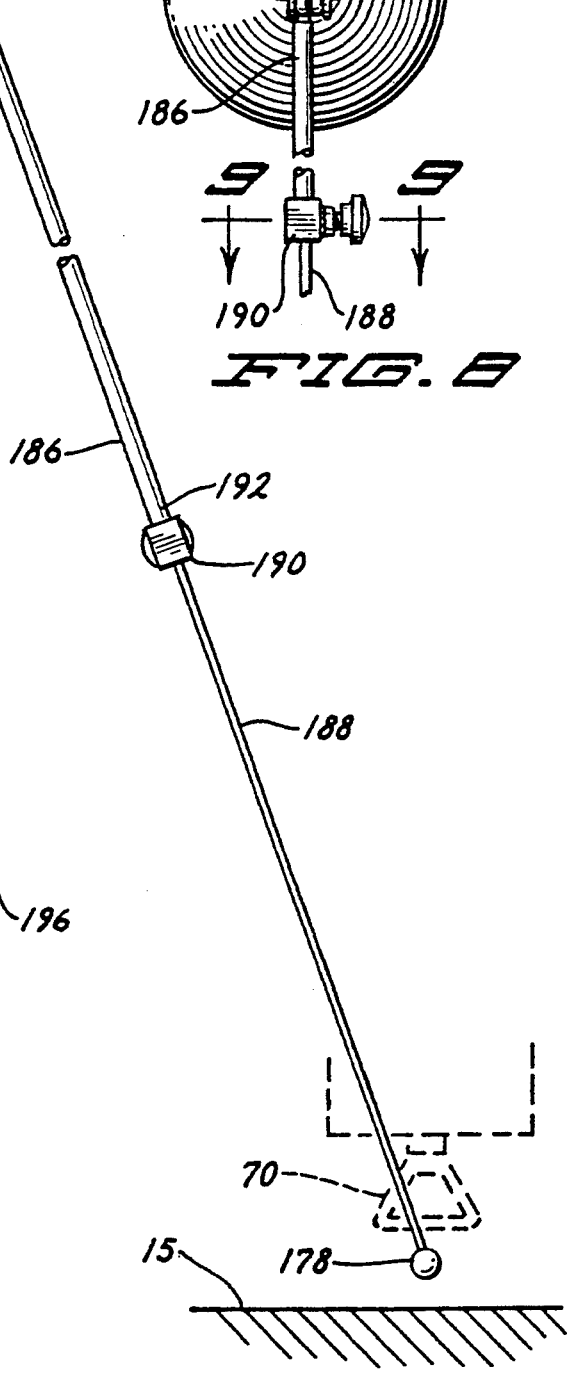

STRIPING APPARATUS FOR VEHICLE TRAVEL SURFACES

BACKGROUND OF THE INVENTION

This invention relates generally to painting apparatus. More particularly, this invention pertains to apparatus for painting stripes on surfaces for traffic control.

Stripes are applied to roadways, parking lots, warehouse floors and the like for directing the movement and placement of vehicles. Durable paints are sprinkled with small reflecting beads to ensure long term nighttime visibility of the lines with vehicle headlights.

Prior art painting systems used to apply marking lines to longer lengths of highway generally use large vehicles dedicated to a single use. Because of their large size, lack of maneuverability, high labor consumption and expense, these machines are generally inappropriate for use on smaller projects such as parking lots, building floors, short sections of roadway repair and the like. Such applications generally require enhanced maneuverability because of short lines, line discontinuity, comers and the presence of obstacles to be avoided.

Prior art systems installed in a truck bed and/or on a truck chassis typically require extensive modifications to the vehicle, and may include means for powering the painting apparatus from the vehicle engine. Use of such machines typically requires one or two riding operators in addition to the vehicle driver. Such vehicles are dedicated to the single purpose of line striping.

In these vehicle mounted units, mounting and dismounting of the paint striping apparatus is generally a long and arduous process.

Trailer mounted line markers are difficult to maneuver in cramped spaces. In addition, it is very difficult to obtain straight lines with trailer mounted units because the articulation produces a cyclic lateral motion resulting in a wavy line.

In view of the prior art, the need exists for a surface line marker which may be quickly and easily mounted on a pickup truck or other utility vehicle. Furthermore, a line marking system is needed which may be quickly converted frown an operating configuration to a transport configuration for driving at highway speeds. Such an apparatus which permits the vehicle to be used for other purposes merely by quick, simple removal of the spray system is very desirable, reducing the need for multiple vehicles.

BRIEF SUMMARY OF THE INVENTION

The invention is a line striper which attaches quickly and easily to the rear end of a pickup truck or other vehicle with a standard hitch receiver or receivers. The complete painting system, except for the paint containers, may be mounted on a frame including at least one forwardly extending square tubing beam configured to be inserted and locked in a standard square hitch receiver. Although a single support beam may be used when the total weight is low, i.e. less than about 200–300 pounds, two or three support beams are recommended when the total weight is more than 300 pounds.

The hitch receiver(s), typically designated as Class III receivers, accept standard two inch by two inch square tubing which acts as a box beam. Such receivers are rated for supporting a "tongue weight" of 500 pounds. The receivers are useful for pulling trailers, wheeled compressors and other equipment used by construction contractors. A standard hitch receiver provides a versatile system for accepting any hitch insert of the same size. As commonly used, various hitch inserts may be configured to hold different size hitch balls or be mounted with the hitch balls at differing ground clearance, etc. for towing a variety of rolling equipment. Each hitch insert is locked in the receiver by passing a metal crosspin through matching holes in the receiver and insert, and applying a retaining pin to the crosspin to lock it in place. Downwardly directed forces of the load are absorbed by the receiver while axially directed forces are absorbed by the crosspin acting on the receiver.

The frame has retractable jack legs with forwardly extending wheeled feet which permit easy mounting and dismounting of the apparatus by one person, and allow the unit to be separately moved and stored in an upright position, ready for quick, simple installation on the vehicle.

A wheeled extension and with attached spray heads and bead dispenser is pivotally attached to the striper frame for stripe painting, and may be raised, transversely retracted, and locked to the frame for travel at highway speeds.

Also mounted on the frame are an air compressor, an airless paint pump with a gasoline engine, paint and air hoses, and a warning light. The framework accommodates a hand gun for spraying lettering and the like on horizontal and vertical surfaces. A tank for holding reflective beads is also included, for applying beads to the painted stripe(s). The flows of paint and beads are controlled by air operated valves where the air flow to each spray head and bead dispenser is controlled by an electrical solenoid valve.

A remote controller extends to the driver's compartment of the vehicle for easy one-person operation and control of the painting system while driving the vehicle. The only utility connection to the vehicle is a detachable electrical connector for powering the compressor, warning light, the solenoid valves and the electronic control system itself.

Another aspect of the invention is a lightweight extensible line guide which requires no mounting brackets, bolts, screws or similar attaching means. The line guide has a magnetic base which attaches to the vehicle body by simple placement at the desired location. The line guide is removed by lifting it from the vehicle body by hand.

The line striping system of this invention has many advantages. First, the invention requires no equipment to be permanently mounted in or on a track bed or tailgate. Thus, the vehicle is not dedicated for paint striping use alone, but may be used for any other purpose for which it is intended. Second, the frame carrying the painting equipment may be dismounted from the vehicle merely by jacking down the jack legs, removing one or two pins and pulling the frame from the hitch receivers. The only apparatus required to be "permanently" mounted on the vehicle are the hitch receivers and an electrical connector. The presence of these items does not preclude other uses of the vehicle. To the contrary, a hitch receiver and electrical connector are installed in such vehicles for towing of trailers carrying other construction equipment.

The striping apparatus is readily vehicle-mounted or dismounted in a matter of minutes, and may be stored in a small space. It may be stored in a configuration for immediate quick mounting to the vehicle.

These and other aspects and advantages of the invention will be readily understood by reading the following description in conjunction with the accompanying figures of the drawings wherein like reference numerals have been applied to designate like elements throughout the multiple views.

BRIEF DESCRIPTION OF THE DRAWINGS

FIG. 1 is a lateral, partially cut-away view of the paint striping apparatus of the invention, mounted on the rear end of a pickup truck vehicle and in position for use;

FIG. 3 is a partially cut-away rear view of the vehicle supported paint striping apparatus of the invention;

FIG. 8 is a front view of the line guide of the invention;

FIGS. 10*a* and 10*b* together comprise a simplified schematic diagram of the pneumatic, electrical, paint and bead circuits of the invention.

DESCRIPTION OF THE PREFERRED EMBODIMENTS

Figure 7:
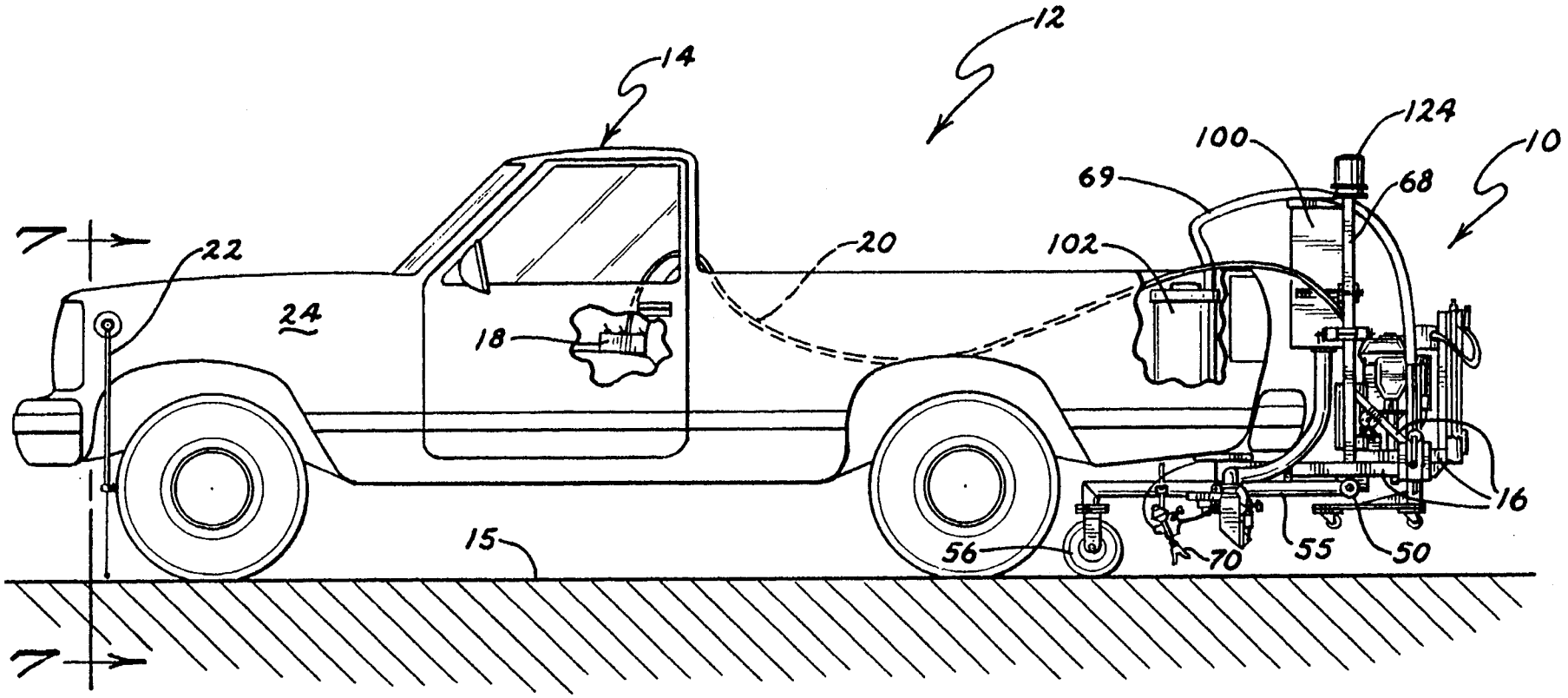
FIG. 7 is a lateral view of the line guide of the invention, being aligned with a paint spray nozzle ,Shown in phantom.

With reference to the drawings, and particularly to FIG. 1, a striping apparatus 10 is shown mounted on the rear of a vehicle 12 shown as a pickup truck with a cab 14. The primary purpose of the apparatus is to paint traffic control stripes on generally horizontal traffic surface 15 which typically comprises a roadway, a parking lot, a floor of a building, etc. The apparatus may include means for applying reflective beads to the painted stripe. The apparatus 10 is illustrated as a self-contained stripe painting assembly which includes a framework 16 removably secured to the vehicle 12. A control unit 18 is connected by control lines 20 to various electrical energy consuming equipment such as an air compressor, paint pump, solenoid valves, and a flashing warning light. The line striping operations may be controlled from the cab 14 by the vehicle's driver, enabling one-person operation. A detachable line guide 22 is shown mounted to the front fender 24 of the vehicle 12 for guiding the paint application. Minimal effort and time are required for installing the apparatus 10 on the vehicle, or removing it therefrom.

Figure 2:
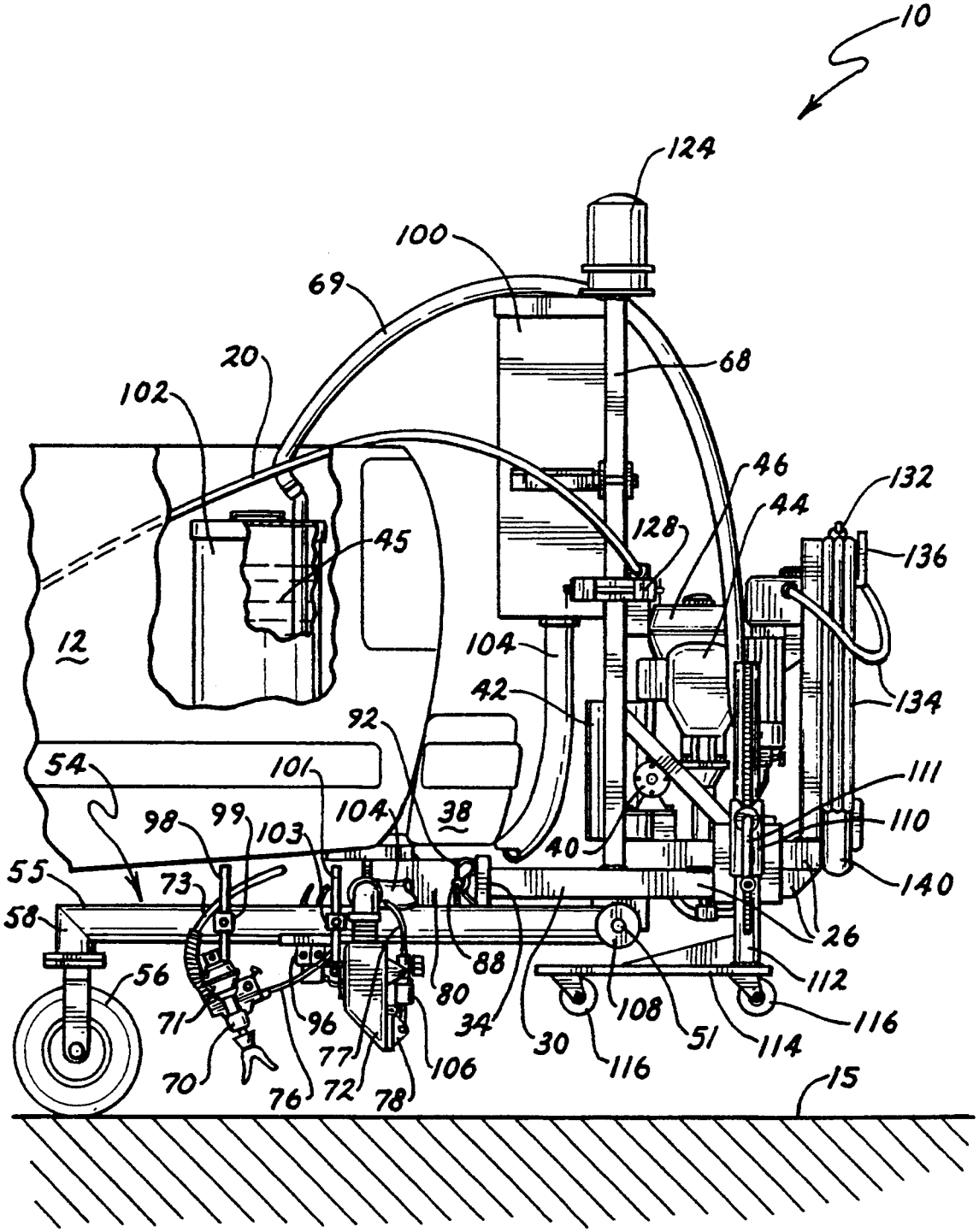
FIG. 2 is an enlarged lateral, partially cut-away view of the rear mounted paint striping apparatus of the invention.
Figure 4:
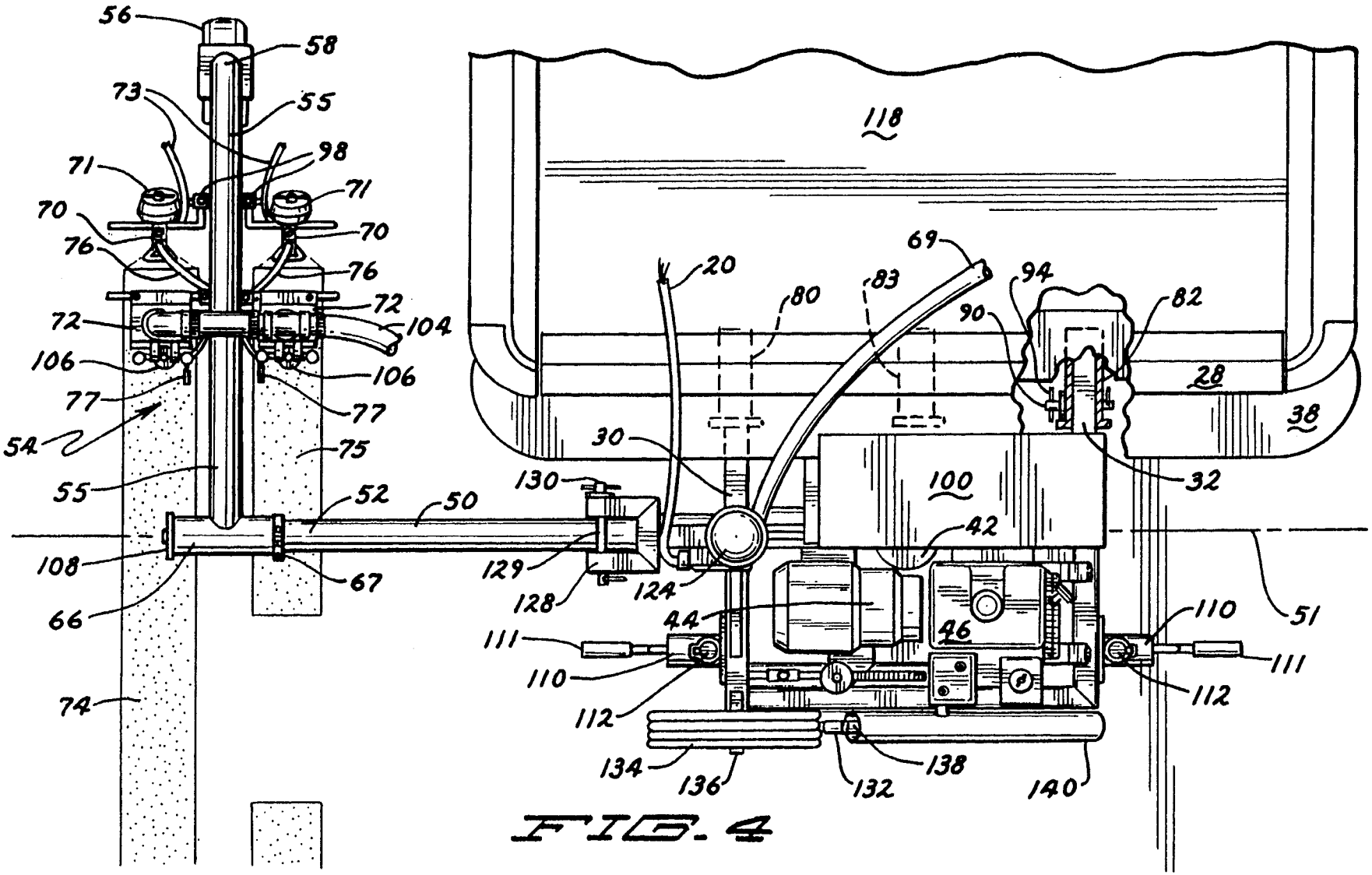
FIG. 4 is a partially cut-away top view of the vehicle supported paint striping apparatus of the invention.

FIGS. 2 through 4 show the striping apparatus 10 in side, rear and top views for clarity of the construction details. Because of the large number of components comprising the illustrated apparatus 10, not all components appear in each figure. FIGS. 2–4 should therefore be viewed together.

As shown in the figures, the primary structural elements of the apparatus include a suspension framework 16, a transverse boom 50 laterally extensible from either the left or right side of the framework 16, a retractable wheeled carriage 54 which may be mounted on either end of the transverse boom 50, and a pair of jacks 110 mounted on the left and right sides of the framework 16. Each jack leg 112 has a foot 114 with casters or wheels 116, permitting the entire striping apparatus to be stored or rolled on the ground at an elevated level enabling rapid mounting on a vehicle, or at a lower level. The jack feet 114 may be jacked upwardly, i.e. retracted by manually turning crank handles 111, when the apparatus is mounted on the vehicle, so that the framework 16 is entirely supported by the vehicle 12 for travel.

The figures show the framework 16 as including square tubing beams welded together in a horizontal, generally rectangular base 26. Other framework members are joined to the base 26 to extend therefrom for supporting an air compressor 40 with an air tank 42, a paint pump 44 and its attendant gasoline engine 46, a bead tank 100 and other components. A transverse support member preferably in the form of a tubular sleeve 48 with axis 51 is also fixedly attached to the framework 16 by plates 49 for coaxially holding an outrigger boom 50. Outrigger boom 50 is preferably of smaller diameter than the sleeve 48 and it is telescopically slideable within the sleeve to extend distally outwardly from the left end 60 or right end 62 of the sleeve 48 to beyond the side of the vehicle 12. The outrigger boom 50 may be locked in any particular axial position in the boom sleeve 48 with e.g. u-bolts, locking bands 47 (FIG. 3), pins or other means known in the art.

An outrigger striping carriage 54 including a forwardly extending extension arm 55 is shown attached to the extended end 52, e.g. left end of the outwardly extended boom 50 to swivel or pivot thereabout normal to the central axis 51. As illustrated, the rear end 64 of the arm 55 includes an outer hub 66 which slides over the boom 50. A flange 108 having a screw-expandable insert portion is shown inserted into the end of the boom and tightened therein for retaining the hub 66 on the boom 50. A similar flange 65 locks the opposite, i.e. non-extended end of the boom 50 at the corresponding end 60 or 62 of the sleeve 48. The hub 66 is further retained at the desired position on the boom 50 by a removable band, U-bolt, pin or other device 67.

A wheel 56 is mounted to the front end 58 of extension arm 55 to ride on the surface 15 during striping operations. The wheel 56 is mounted to have a fixed line of travel, i.e. it does not swivel about a generally vertical axis. Thus, the wheel 56 is not free to meander or wobble, actions which produce crooked lines.

The wheel 56 may also serve to provide a travel distance signal for a "skip timer" controller 120 (see FIG. 10), whereby a discontinuous paint stripe or stripes having a specified line length and skip length may be applied. A distance sensor 122 having a magnetic or other signal pickup transmits a signal used for distance determination by the "skip timer" controller 120. Such a controller may also be used to conform the newly painted and beaded stripes to coincide with and cover existing broken stripes. The functions of the skip timer controller 120 are typically incorporated into the control unit 18 for operation by the driver in the cab.

Returning to FIGS. 2–4, the rear end 64 of the spray carriage 54 is shown as terminating in a transverse sliding hub means 66 which is selectively locked at the left end 60 or right end 62 of the outrigger boom 50. Thus, the striping operations may be carried out on either the left or right side of the vehicle. The carriage 54 is shown mounted on the outrigger boom 50 so that the carriage 54 moves in a line laterally outside of the vehicle's path. Thus, the painting operations may be spaced outwardly from either the left side or fight side of the vehicle.

The wheel 56, mounted on the extension arm 55 which is free to pivot about axis 51, rides smoothly over irregularities in the surface 15, maintaining the desired spray distance and line width. When not in operation, the carriage 54 may be pivoted upwardly to a vertical position, slidingly moved toward the staff 68 parallel to axis 51, and locked into a boom retaining bracket 128 on staff 68 for on-vehicle storage or transport. As shown in FIGS. 3 and 4, the bracket 128 may be a bifurcated member with holes for passage of a locking bar 129 therethrough. Cotter pin(s) 130 or other retaining device(s) may be used to maintain the bar 129 in a locked position. Other locking methods may also be used.

One or more paint spray nozzles 70 and reflective bead applicators 72 are mounted on the carriage 54 for applying elongate traffic control lines 74 to surface 15. Compare FIGS. 2 and 4. As illustrated, each of two paint nozzles 70 is followed by a bead applicator 72. Each nozzle 70 is associated with an air valve 71 which opens and closes the flow of paint through paint tubing 73 from pump 44. Likewise, each of the bead dispensers 72 is supplied by a bead tube 104 carrying self-flowing beads by gravity from the bead tank 100 and has a gate 78 opened by an air valve 106. The flow of pressurized air through lines 76 and 77 to the air valves 71 and 106, respectively is controlled by a 12 volt solenoid valve assembly 96 having a valve in each air line or set of air lines which is controllable from the vehicle cab 14 by manipulation of remote control unit 18.

It should be noted that to enhance the clarity of the figures, obstructing portions of the conduit members for carrying paint, beads, and air are not fully shown in all of the drawings.

As depicted in the drawings, each of the nozzles 70 is mounted on a rod 98 which is adjustably lockable by a set screw 99 at a desired adjustable height above the roadway surface 15. Likewise, each of the bead dispensers 72 is mounted on a rod 101 adjustably lockable by set screw 103, and dispenses reflective beads 79 onto the stripe 74, 75 just painted by the preceding nozzle 70.

For most applications, a line or stripe width of 4 inches is used, but the width may be varied by using alternative spray nozzles 70 and/or varying the distance between spray nozzles 70 and the surface 15 to be painted.

As shown in the figures, the frame base 26 of framework 16 includes two spaced-apart square tubing beams 30, 32 which extend forwardly from the framework 16 and are aligned with the vehicle's line of travel. The front portions 34, 36 of these square tubing beams 30, 32, respectively comprise slide bar hitches which may be slidingly inserted into corresponding standard hitch receivers 80, 82 mounted on the vehicle 12. Crosspins 88, 90 are inserted through corresponding holes 84, 86 in the receiver(s) and slide bar hitch(es) and are locked in place with retaining pins 92, 94.

A popular hitch system designated as a Class III hitch uses a receiver 80, 82 which accepts a two-inch square slide bar hitch or insert. The receiver is typically mounted on a vehicle by welding or bolting the front end of the receiver to a mounting member which is adapted for attachment to the particular vehicle. For example, the receivers are often welded to the rear surface of a structural member (e.g. a length of square tubing) which spans the rear end of the vehicle, being bolted or welded to it. The receivers project rearwardly from beneath the vehicle's rear bumper 38.

In this invention, the two receivers 80, 82 are spaced to provide added strength against torsional forces. The beams 30, 32 to be inserted in the receivers 80, 82 are formed of 2-inch square steel or stainless steel tubing having a wall thickness of $\frac{1}{8}$ to $\frac{1}{4}$ inch, depending upon the weight to be supported. The receiver is bolted or welded to the vehicle frame such that the a "tongue" static weight rating of 500 pounds and a hitch axial load rating of 5000 pounds is achieved for each receiver/-slide bar hitch. The receivers 80, 82 project rearwardly from beneath the vehicle rear bumper 38. Thus, the weight of the entire line marking apparatus 10, including framework 16, air compressor 40, air tank 42, paint pump 44, gasoline engine 46, bead tank, and applicators (but excluding the large paint containers 102) is suspended from the two receivers 80, 82. The paint container or containers 102 are typically carried in the vehicle 12, such as in the bed 118 of a pickup truck, for supplying the paint pump 44 through paint supply line 69. Of course, if desired, the paint container 102 may be carried on the framework 16 as well.

As shown in FIG. 4, a hitch system may include an additional hitch receiver 83 centrally mounted to the vehicle 12 for towing trailers. In one embodiment of the invention, the striping apparatus 10 is supported from a single beam of square tubing rather than two, and the single beam is lockingly mounted in the central hitch receiver 83 or a side receiver 80 or 82. More than one hitch receiver is then not required unless a choice is desired in mounting the apparatus. This version is particularly useful when relatively lightweight, light duty stripe applying components are mounted on the framework 16.

In a further embodiment useful where the particular equipment mounted on the framework 16 is too heavy for support by one or two beams of square tubing, a third square tubular beam may be added to the framework, for supportable insertion in the central receiver 83.

While the striping apparatus described herein is adaptable to any vehicle to which the hitch receivers may be mounted, it is anticipated that in most cases, a pickup truck will be utilized. Such vehicles vary widely in size, load capacity, and hitch height above the ground level, etc. Although the figures show the tubular sleeve 48 suspended below the box beam 30 of the framework 16, the sleeve 48 may optionally be mounted above the box beam 30, particularly for mounted use on vehicles 12 having their hitch position lower to the ground 15. For such vehicles, it may be advantageous to use jacks in which the legs may be swiveled upwardly about a horizontal axis. The feet may then be lifted to a position in which the overall ground clearance is increased. Such swivelable jacks are commonly used on boat trailers, and are commercially available.

As shown in FIGS. 1–4, the apparatus may include a hand held paint sprayer 132 with sufficient tubing 134 for painting lettering and the like on the ground surface 15 or on other surfaces such as walls. The tubing 134 is shown coiled on tubing rack 136, and the hand held sprayer has a spray head 138 shown stored in holster 140.

Figure 5:
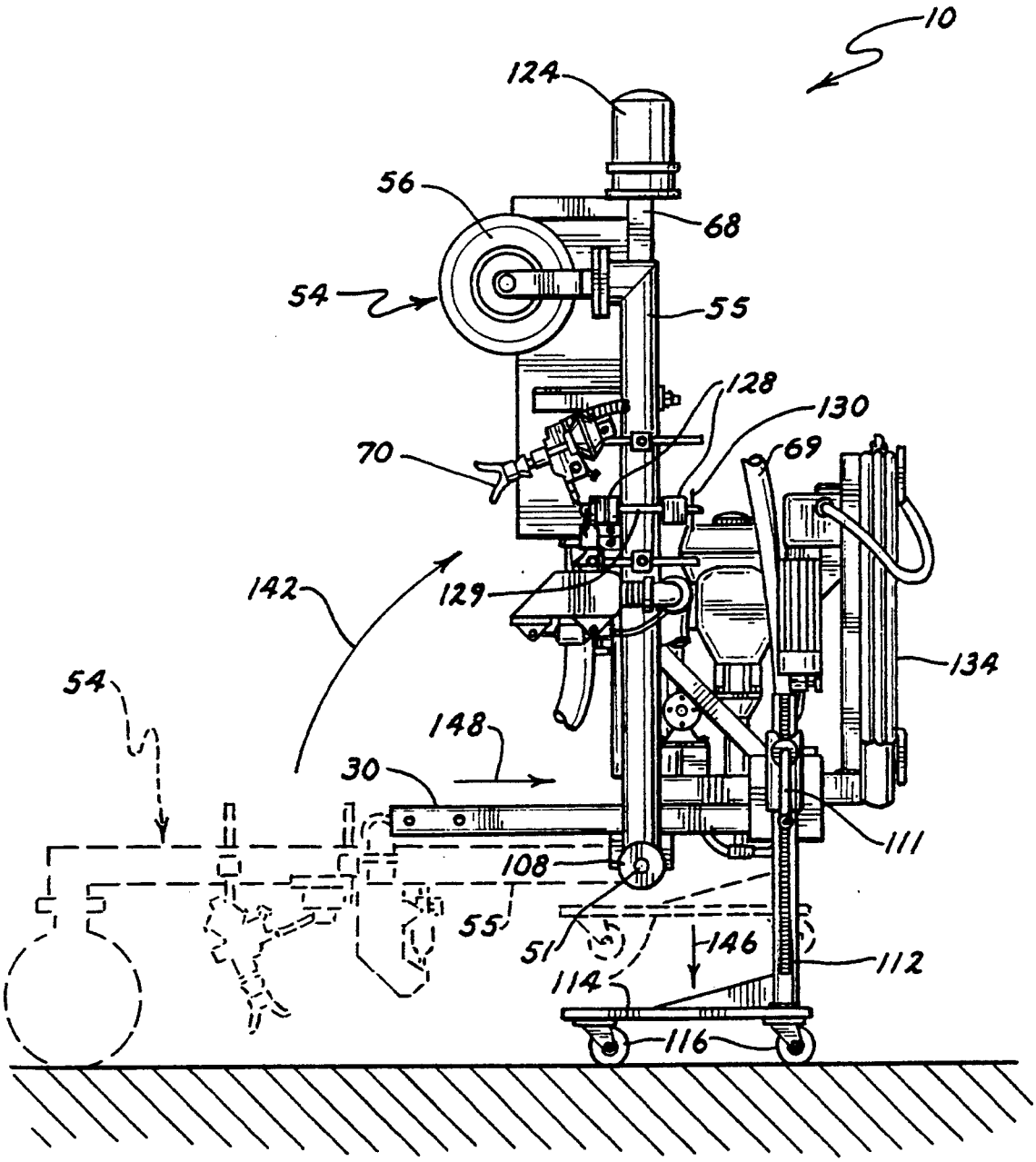
FIG. 5 is a lateral view of the paint striping apparatus of the invention in the collapsed self-supporting storage position, with the as-mounted operating position shown in phantom.
Figure 6:
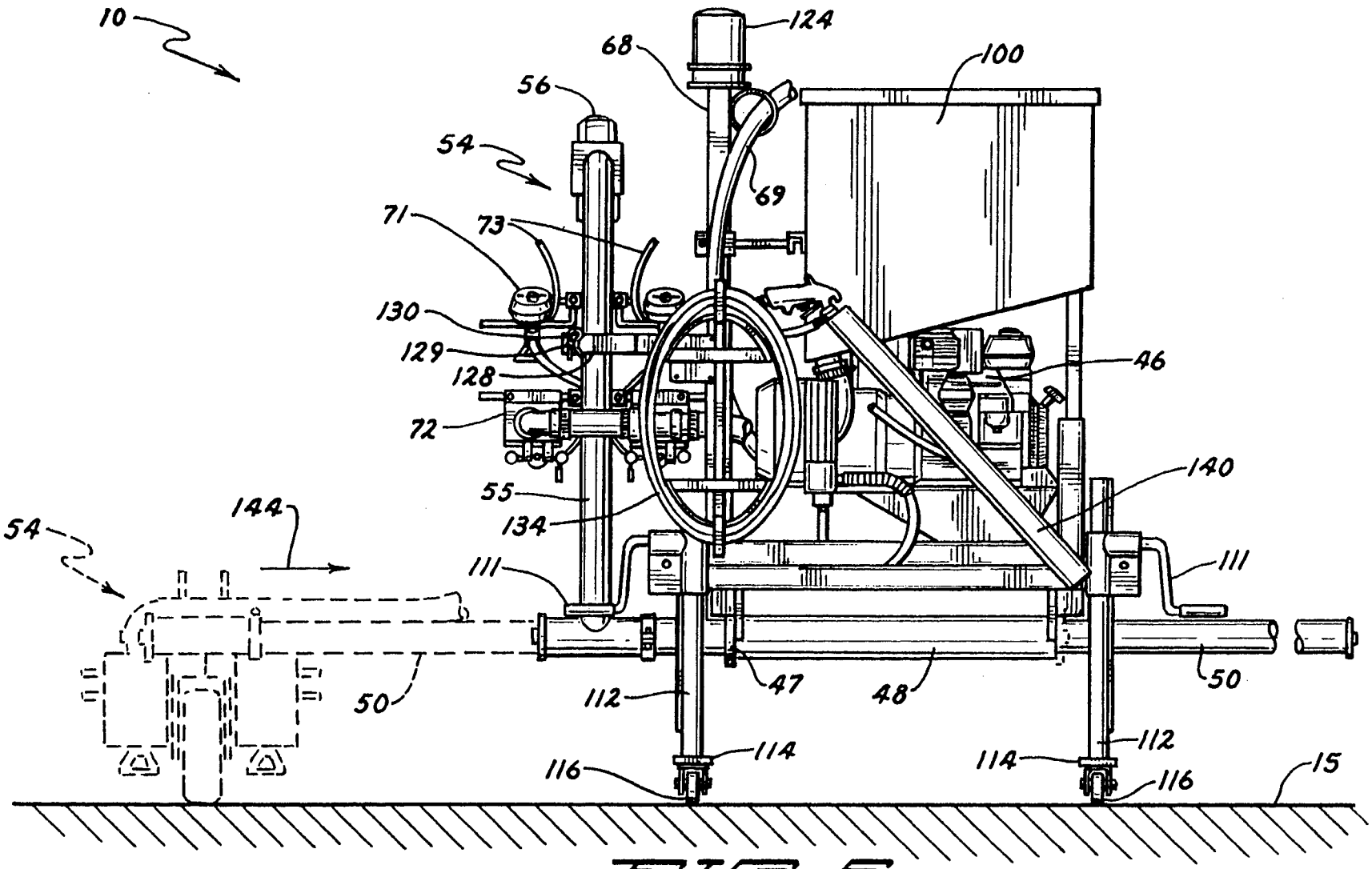
FIG. 6 is a rear view of the paint striping apparatus of the invention in the collapsed self-supporting storage position, with the as-mounted operating position shown in phantom.
Figure 7A:
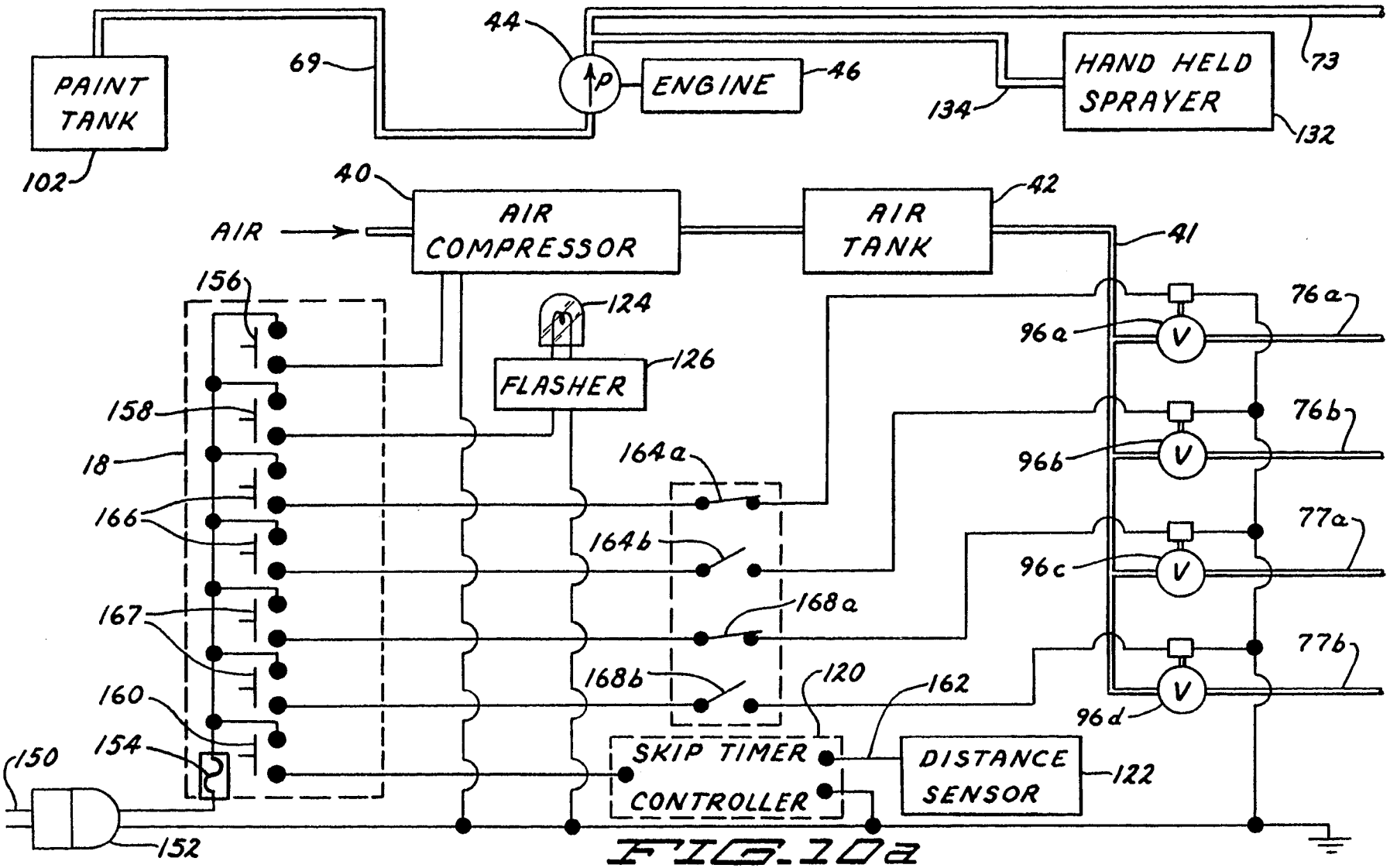

FIGS. 5 and 6 depict the striping apparatus 10 in an unmounted storage position and also show the operations required to dismount the apparatus from a vehicle.

For one version of this striping apparatus, the paint pump 44 and engine 46, together with hand-held spray head 132 are together available from Graco Inc. mounted on a model GM5000 can-mounted sprayer unit. The spray heads or nozzle units 70 may comprise those obtainable from Graco Inc., as e.g. Hydra-Spray Guns, series J.

As shown in FIG. 5, carriage 54 is rotated upwardly 142 about axis 51 to place its extension arm 55 in a generally upright position. As shown in FIG. 6, the locking band 47 locking the outrigger boom 50 in an extended position (shown in phantom) is loosened to permit the boom 50 to then slide 144 into the transverse tubular sleeve 48. The extension arm 55 of the raised carriage 54 is inserted into the bracket 128 and retained therein by a bar 129 locked in the bracket with a retaining pin e.g. cotter pin 130. The bracket 128 is shown attached to light staff 68.

The conduits for paint, beads and air, together with the electrical wires 20 are flexible and simply bend as the carriage 54 is rotated and moved transversely.

As depicted in FIG. 5, the wheeled feet 114 on jack legs 112 are lowered 146 by turning handles 111, until the apparatus 10 is supported by engagement of the wheels 116 with the ground 15. The hitch insertable square tubing members 30, 32 are unlocked by removal of pins 88 as previously described, and the striping apparatus 10 is rolled backward 148 to disengage the members 30, 32 from the hitch receivers of the vehicle. Of course, the paint conduit 69 must be removed from the paint container in the vehicle bed, tile electrical connector must be disconnected and the control box must be removed from the vehicle driver's compartment before the vehicle can be driven away.

Once removed from the vehicle, the striping apparatus may be wheeled by one person to a storage location. If desired, the apparatus may be lowered by cranking it down on the jacks 110.

The apparatus 10 is mounted on a vehicle by reversing the above indicated steps, all of which may be done by one person.

Figure 10B:
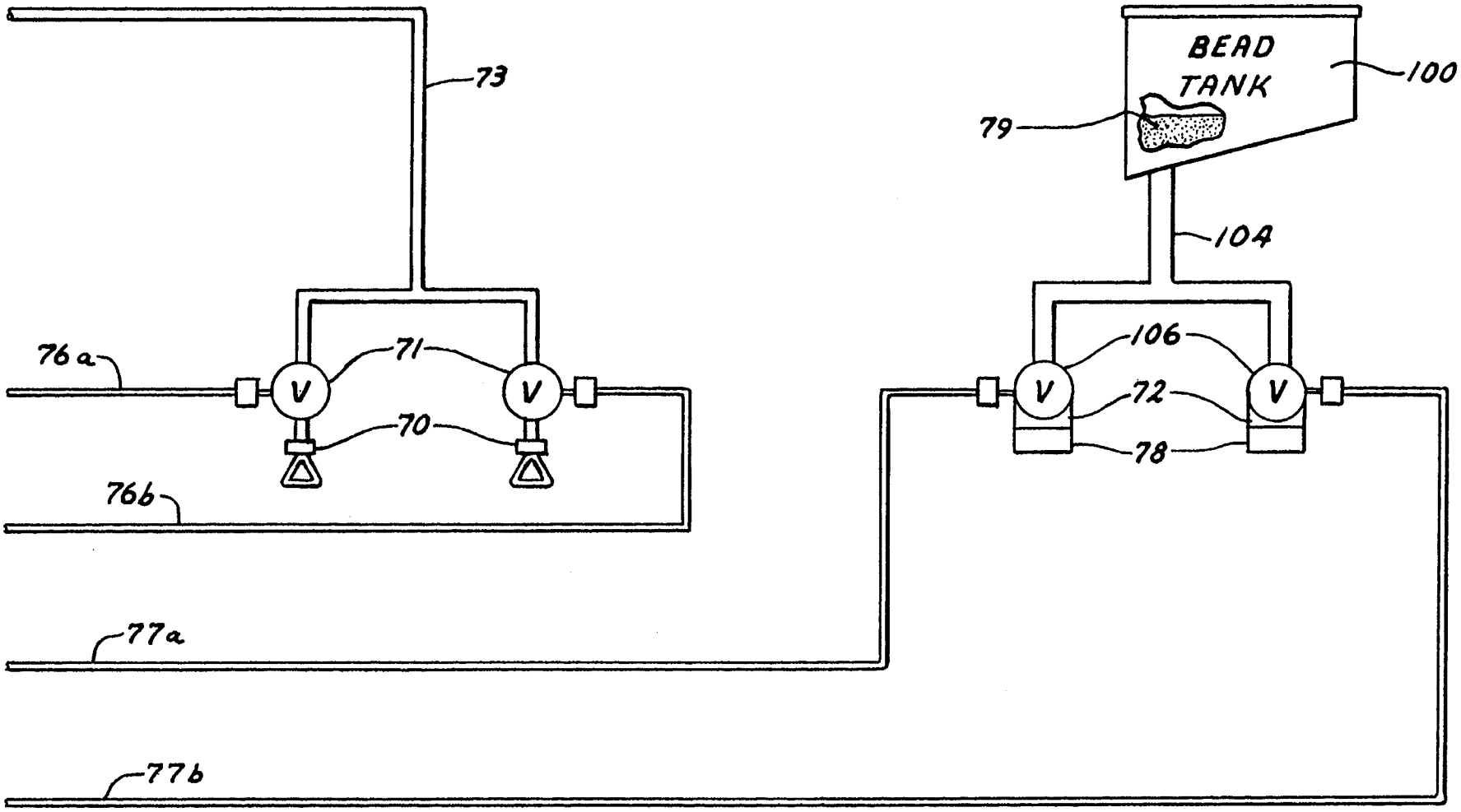

FIGS. 10*a* and 10*b* together comprise a schematic representation of the electrical, paint, air and bead circuits of the line striper 10, and show the control system which the driver of a vehicle may use for operating the striper 10.

Paint 45 is pumped from container 102 through conduit 69 by paint pump 44. The paint pump 44 is depicted as driven by a small internal combustion engine 46. The paint 45 is delivered from the pump through conduit 73 to the nozzles 70 mounted on the carriage 54, or through conduit 134, i.e. flexible tubing to the hand held sprayer 132 with a manual control valve directing paint flow to the sprayhead 138 (see FIG. 3).

Reflective beads are delivered by gravity from bead tank 100 through conduit 104 to the bead applicator 72.

Paint delivery to the nozzles 70 for painting surface 15 is controlled by air actuated valves 71, and the bead applicator 72 includes a gate 78 which is actuated by an air valve 106.

Air is compressed by air compressor 40 and stored in air tank 42 at elevated pressure. Pressurized air is delivered through air conduit 41 to each of the valves 71 and 106 through conduits 76*a* and 76*b* for controlling the flow of paint 45, and through conduits 77*a* and 77*b* for controlling the flow of beads 79. The air supply to each of the conduits 76 and 77 is controlled by electrical solenoid valves 96*a*, 96*b*, 96*c*, and 96*d*. AH of the solenoid valves may be included in a single valve bank shown as bank 96 in FIG. 2, if desired.

A control panel 18, preferably capable of operation remotely from the paint and bead application, is schematically depicted as receiving 12 volt electrical power from the vehicle's electrical system 150 through a connector 152 and circuit breaking means 154. The panel 18 typically includes switch 156 for activating the air compressor 40, switch 158 for activating the warning tight 124 having a flasher 126, switch 160 for activating a skip timer/controller 120, switches 166 for independently activating each of the line striper paint nozzles 70, and switches 167 for independently activating each of the bead dispensers 72. As already described, each of the valves or gates controlling the flow of paint and beads is actuated by compressed air controlled by an electrical solenoid valve.

A skip timer/controller 120 is typically included in the control panel 18. A distance sensor 122 determines the length of a painted stripe 75 (see FIG. 4), and the distance between longitudinally spaced stripes, receiving distance signals 162 based on the rotation of carriage wheel 56. The skip timer/controller 120 is adjustable to uniformly control the stripe and interstripe, i.e. gap, distances of either the left or right stripe, or possibly both stripes through switches 164*a*, 164*b*, 168*a* and 168*b*. These switches effectively override switches 166, 167 to apply a repeating time function to the activation of the valves controlling the flow of paint and beads. Electrical circuits for skip timer/controllers are known in the art.

The precise starting point and ending point for each stripe section may be made adjustably controllable to permit the overcovering of previously applied discontinuous stripes 75.

Figure 9:
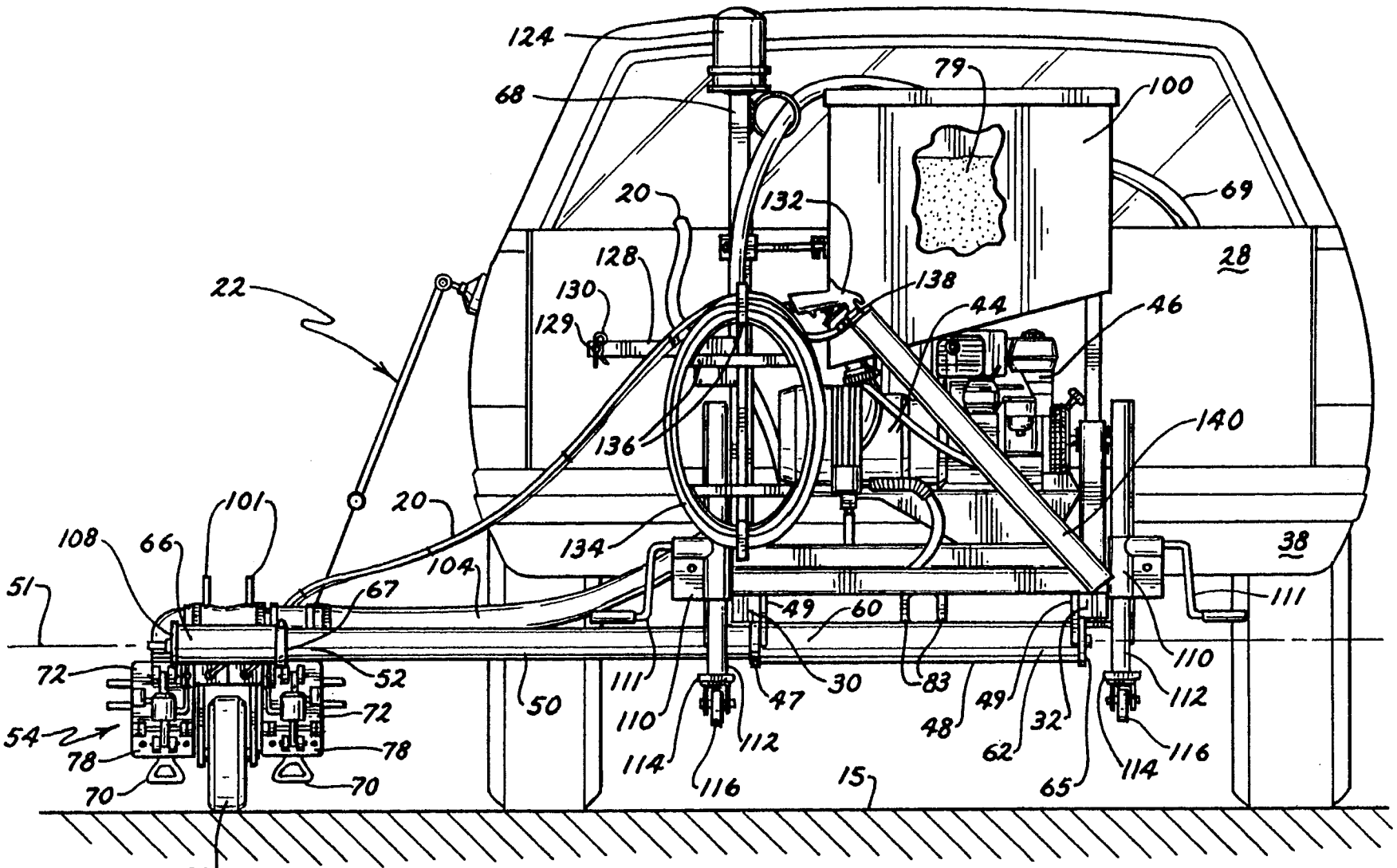
FIG. 9 is a cross-sectional view through the locking clamp of the fine guide of the invention.

As previously considered, FIGS. 1 and 3 show a convenient line guide 22 mounted on the front fender 24 of a vehicle 12. The line guide 22 is shown in greater detail in FIGS. 7–9. The line guide is configured to provide a visible guide node 178 suspended above the path which the applied stripe will follow on surface 15, or other path related thereto. The attached node 178 may be of any shape, and is visible to the vehicle's driver so that the vehicle may be steered to apply the stripe in the desired path. Preferably, the node 178 is formed of a lightweight material and has a fluorescent color for enhanced visibility.

The line guide 22 includes a magnetic mount 170 comprising a permanent magnet 172 enclosed or encapsulated in a generally soft, pliable material 174 such as a plastic. The magnet 172 has a flat side 176, preferably covered with a thin coat of the plastic material 174, for magnetic mounting to the vehicle's steel fender 24 or other ferric part without scratching the surface thereof. A post 180 is shown extending from the mount 170 and terminating with an adjustable frictional pivot fitting 182 at the proximal end 184 of elongate hollow tube 186. The tube 186 acts as a ferrule in which rod 188 may slide, and includes a hollow fitting 190 at its distal end 192 for locking the rod 188 into the tube 186 at the desired extension. A set screw 194 with a hand manipulable knob 196 engages the rod 188 within the fitting 190 to lock the rod 188 at the desired location in tube 186. The fitting 190 has a body 198 which may be joined to the tube 186 by welding, brazing or cementation, for example, depending upon whether the components are formed of metal, plastic or other material. The body is shown with a threaded nut 200 joined to it for carrying the set screw 194.

If desired, several nesting or telescoping tubes, not shown, may be used in place of the single tube 186 illustrated.

In contrast to the bulky, difficult-to-mount line guides in current use, this line guide is extremely lightweight and is mounted by simply pressing it onto the vehicle body 12. It is retained in the desired position by magnetic force, requiting no bolts, screws or other hardware mounted through the fender wall. The position of the guide node 178 is easily and rapidly adjusted to the desired location. Once set, it retains the position until readjusted. It requires no wheel to maintain the desired spacing from the roadway surface. The guide 22 is easily and inexpensively constructed. The line guide 22 collapses to a small size for storage under or behind a seat, or on the striping apparatus, for example.

It is anticipated that various changes and modifications may be made in the construction, arrangement, operation and method of construction of the striping apparatus disclosed herein without departing from the spirit and scope of the invention as defined in the following claims.

What is claimed is:

1. A striping apparatus for attachment to a vehicle for applying a stripe to a surface, comprising:

a framework for supporting striping means, said framework including at least one framework member removably attachable to one end of a vehicle;

an elongate support member fixedly mounted to said framework along a transverse axis thereof;

an outrigger boom having an axis, said boom selectively moveable on said support member between a laterally extending operating position and a retracted storage and transport position; and an outrigger carriage attached to said outrigger boom and movable therewith, said carriage pivotable from said outrigger boom in a plane normal to said boom and having a rotatable wheel for riding on said surface, and means for forming a painted stripe on said surface during forward movement of the vehicle.

2. The striping apparatus of claim 1 wherein said elongated support member is a tubular sleeve, and said outrigger boom has a length less than the width of the vehicle and is slidably movable in said sleeve between said operating and retracted positions, said boom being movable to extend laterally beyond one side of the vehicle in said operating position.

3. The striping apparatus of claim 2 wherein the length of said tubular sleeve is configured for selective extension of the outrigger boom beyond one of the left side and the right side of said vehicle for positioning said outrigger carriage on the surface laterally spaced from the side of the vehicle.

4. The striping apparatus of claim 1 wherein said outrigger carriage comprises an elongate extension arm having one end thereof pivotally attached to the laterally outer end of the outrigger boom and projecting generally normal to the boom, said arm being swingable on the boom between a generally horizontal operating position and a generally vertical transport position.

5. The striping apparatus of claim 4 further comprising a lockable bracket mounted on said framework to retain said pivotable extension arm in said generally vertical position when not in use and for highway travel.

6. The striping apparatus of claim 5 wherein said bracket is mounted on a generally vertical staff of said framework.

7. The striping apparatus of claim 1 wherein said means for forming a painted stripe comprises at least one paint dispensing nozzle, and further comprising paint supply apparatus mounting on said framework for delivering paint under pressure to said nozzle.

8. A striping apparatus for attachment to a vehicle for applying stripe to a surface, comprising:

a framework for supporting striping means, said framework including at least one framework member removably attachable to one end of a vehicle;

an elongate support member fixedly mounted to said framework along a transverse axis thereof;

an outrigger boom selectively movable on said support member between a laterally extending operating g position and a retracted storage and transport position;

an outrigger carriage attached to said outrigger boom and movable therewith, said carriage having a rotatable wheel for riding on said surface and means for forming a painted stripe on said surface during forward movement of the vehicle; and ground support means mounted on said framework and movable between an elevated position out of contact with the ground and a lowered, ground engaging position for mounting the apparatus on a vehicle and for dismounting and storing the apparatus.

9. The striping apparatus of claim 8 wherein said ground support means includes ground engaging wheels movable between said elevated and ground engaging positions, whereby said apparatus may be rolled into position adjacent to rear end of a vehicle for coupling attachment of said framework member to a vehicle mounted hitch receiver.

10. The striping apparatus of claim 9, wherein said ground support means comprises a pair of spaced apart jacks mounted on said framework, each jack having a generally vertical leg carrying at least one wheel at its lower end, and each of said legs being vertically movable between said elevated and ground engaging positions.

11. The striping apparatus of claim 8 wherein said ground engaging support means comprises a pair of spaced apart jacks mounted on said framework, each jack having a generally vertical leg with a support foot on the lower end thereof, and each of said legs being movable between said elevated and ground engaging positions.

12. The striping apparatus of claim 11 further comprising a plurality of wheels mounted on each said jack foot for rollable engagement with said surface while mounting and dismounting said apparatus from said vehicle and during storage of said striping apparatus.

13. A striping apparatus for attachment to a vehicle for applying a stripe to a surface, comprising:

a framework for supporting striping means, said framework including at least one framework member removably attachable to one end of a vehicle;

an elongate support member fixedly mounted to said framework along a transverse axis thereof;

an outrigger boom selectively moveable on said support member between a laterally extending operating position and a retracted storage and transport position; and an outrigger carriage attached to said outrigger boom and movable therewith, said carriage having a rotatable wheel for riding on said surface and means for forming a painted stripe on said surface during forward movement of the vehicle;

wherein said framework member is a square, tubular member configured for supportable, locking insertion into a tubular type hitch receiver mounted on one end of a vehicle.

14. The striping apparatus of claim 13 wherein said receiver comprises a standard Class III hitch receiver and said square tubular framework member comprises a 2 inch square tubular framework member.

15. The striping apparatus of claim 13 wherein said framework includes two or three forwardly projecting square tubular framework members insertable in a matching two or three hitch receivers.

16. A striping apparatus for attachment to a vehicle for applying a stripe to a surface, comprising:

a framework for supporting striping means, said framework including at least one framework member removably attachable to one end of a vehicle;

an elongate support member fixedly mounted to said framework along a transverse axis thereof;

an outrigger boom selectively moveable on said support member between a laterally extending operating position and a retracted storage and transport position; and an outrigger carriage attached to said outrigger boom and movable therewith, said carriage having a rotatable wheel for riding on said surface and means for forming a painted stripe on said surface during forward movement of the vehicle;

wherein said outrigger striping carriage further comprises bead applying means for applying reflective beads to said paint stripe.

17. The striping apparatus of claim 16 wherein said means for forming a painted stripe comprises at least one nozzle, and further comprising paint supply apparatus mounted on said framework and comprising:

paint pump means;

an air compressor and air tank;

first conduit means for carrying paint from a paint container to said paint pump means;

second conduit means for carrying pressurized paint from said pump means to each nozzle;

a container for holding reflective beads: third conduit means for carrying the reflective beads from said bead container to the bead applying means;

valve means in said second conduit means for on/off control of paint flow to said nozzle; bead applying means with a gate openable and closable by an air operated driver;

fourth conduit means for selectively providing compressed air to said valve means and said controllable gate for selective application of said paint and beads to said surface;

solenoid valve means in said fourth conduit means for controlling the flow of compressed air to said valve means and said gate air driver; and controller means comprising switches for activating said solenoid valve means and air compressor.

18. The striping apparatus of claim 17 further comprising a hand-held sprayer with a hand operated valve, said sprayer connected by an elongate paint hose connected to said paint pump means.

19. The striping apparatus of claim 17 wherein said means for forming a painted stripe comprise at least one paint dispensing nozzle, fifth conduit means for carrying pressurized paint from said pump means to said nozzle, and fifth valve means in said fifth conduit means and further comprising a controllable skip-timer controller operably connected with said fifth valve means for creating a discontinuous stripe, said skip-timer controller including a distance sensor which measures the forward distance moved by said apparatus and a selectable skip-timer control means for controlling the length of said painted stripe and the frequency and axial length of nonpainted gaps therein.

20. The striping apparatus of claim 17 wherein said paint pump means comprises an airless paint pump and a fueled engine for driving said pump.

21. The striping apparatus of claim 17 wherein said bead container is supportably mounted on said framework.

22. The striping apparatus of claim 10 further comprising a bead container and bead conduit means, said bead conduit means for carrying beads from the bead container to the bead applying means, wherein said vehicle is a pickup truck with stake pockets in the sides of the vehicle bed, and said bead container includes a downwardly directed stake member mountable in one of said stake pockets.

23. A self-contained fine striping apparatus supportable on one end of a self-propelled vehicle, comprising:

a framework on which paint striping apparatus is supported, said framework including attachment means for supporting attachment to one end of a self-propelled vehicle whereby the framework is supported from the end of the vehicle in suspended relation thereto;

an outrigger carriage supported from the framework and having a rotatable wheel for riding on a surface traversable by the vehicle;

paint stripe applying means on the carriage;

paint supplying apparatus mounted on the framework for delivering paint under pressure to the paint applying means; and a paint delivery conduit connected between the paint supplying apparatus and the paint applying means;

whereby said framework, outrigger carriage, paint stripe applying means, paint supplying apparatus, and paint delivery conduit are essentially completely exterior the vehicle.

24. The self-contained line striping apparatus of claim 23, further comprising ground support means mounted on the framework and movable between a ground engaging position and an elevated transport position.

25. The self-contained line striping apparatus of claim 23, wherein the carriage is selectively movable between an extended operating position and a retracted transport position.

* * * * *